United States Patent [19]

Culver

[11] Patent Number: 4,993,472

[45] Date of Patent: Feb. 19, 1991

[54] METHOD OF MAKING FINGERPRINT JEWELRY

[76] Inventor: Kirk L. Culver, 831 Wayne Ave., New Smyrna, Fla. 32168

[21] Appl. No.: 539,171

[22] Filed: Jun. 18, 1990

[51] Int. Cl.[5] ..... B22D 7/02; B22D 9/04

[52] U.S. Cl. ..... 164/35; 164/45

[58] Field of Search ..... 164/35, 45

[56] References Cited

U.S. PATENT DOCUMENTS

| | | | |
|---|---|---|---|
| 964,499 | 7/1910 | Delabarre | 164/35 |
| 1,238,789 | 9/1917 | Kralund | 164/35 |
| 4,508,156 | 4/1985 | Banks et al. | 164/35 |

FOREIGN PATENT DOCUMENTS

| | | | |
|---|---|---|---|
| 2903728 | 8/1980 | Fed. Rep. of Germany | 63/2 |
| 2122069A | 1/1984 | United Kingdom | 63/2 |

*Primary Examiner*—Richard K. Seidel
*Assistant Examiner*—J. Reed Batten, Jr.

[57] ABSTRACT

A novel sprue is used to cut wax and obtain the impressions of finger or other digit prints in a quick and effective manner. The sprue has an elongated handle connected to an impression plate having walls on its perimeter which cut easily through thin layers of wax when downward pressure is applied on the bottom of the impression plate. Then the wax is heated by a heat lamp until the top surface is melted at which time a finger or digit is placed on the wax and with downward pressure applied until an impression of the fingerprint or other digit print is left in the wax. After the wax is cooled then the impression can be imparted in gold or other metal jewelry by standard jewelry casting techniques. The result of this method is a memento that can be attached and worn as a necklace, bracelet, ring or other item of jewelry.

2 Claims, 1 Drawing Sheet

METHOD OF MAKING FINGERPRINT JEWELRY

BACKGROUND OF THE INVENTION

This invention relates to jewelry and the manufacture thereof and more particularly to a new method for making fingerprint jewelry.

Although the process of making jewelry is well known and has been in existence for a long time, a method of effectively and efficiently obtaining impressions of digits such as fingerprints, so as to form fingerprint jewelry has not been perfected. Amongst the pertinent prior patented inventions is U.S. Pat. No. 4,508,156 by Banks et al., dated Apr. 2, 1985, which teaches a method for casting teeth marks in wax. Although the method disclosed in Banks utilizes wax, the process cannot be used to make fingerprint jewelry since a proper impression could not be made of the fingerprint. U.S. Pat. No. 964,499 by Delabarre, dated July 19, 1910, teaches a method of making fingerprint jewelry merely for identification purposes. However, the Delabarre method involves the use of molds to obtain impressions, but would not be effective in obtaining proper fingerprint impressions. U.S. Pat. No. 4,542,631 by Esser, III, dated Sept. 24, 1985, discloses different shaped jewelry but does not involve a method or process in making fingerprint jewelry. U.S. Pat. No. 4,254,552 by Samis, dated Mar. 10, 1981, teaches an automated inscribing system for identification purposes, but does not involve the process of making fingerprint jewelry.

Contrary to the inventions and prior art, the present invention utilizes a method which employs a novel sprue that serves as a combination wax cutter and impression plate in which the wax is heated by a heat lamp or similar means so that that surface of the wax melts slightly to allow a proper fingerprint impression to be made. Once the impression is made the wax impression can be placed in gold or other metal jewelry by a standard jewelry casting means.

SUMMARY OF THE INVENTION

The primary object of the present invention is to provide a method of manufacturing jewelry containing fingerprint or other digit print impressions.

Another object of the present invention is to provide such a method that is efficient and effective in obtaining such impressions so such jewelry can be made on a wide spread scale.

A further object of the present invention is to make an article of jewelry containing fingerprint impressions to serve as a keepsake, memento or identification piece.

The present invention accomplishes the above and other objects by a method which utilizes a novel sprue for obtaining impressions. The novel sprue contains an impression plate with a raised wall on its perimeter, which is used to cut a properly sized piece of wax from a thin sheet of wax. Then said wax on the sprue is heated by means of a heat lamp or other source until the surface of the wax is melted slightly. Then the finger or other digit from which an impression is desired is placed on top of the wax while it is in the impression plate, simultaneously applying a slight downward pressure, which leaves an impression of the print ingrained in the wax. Once the impression is obtained then the impression is imparted to metal by well known jewelry making techniques consisting, briefly, of casting plaster around the sprue leaving a cavity, inserting molten metal into the cavity by pouring or centrifugal force, allowing the metal to cure, heating the cast until only the metal remains and finally, breaking the cast to expose the metal piece with impression. Once the metal piece with the impression is obtained then same may be attached to a loop for placement on a necklace or without a loop directly to a ring to yield the fingerprint jewelry.

Further objects and advantages of this invention will become more readily apparent when the detailed description is provided in conjunction with the accompanying drawings.

BRIEF DESCRIPTION OF THE DRAWINGS

The drawings which are used in conjunction with a description of the preferred embodiments of the invention are as follows.

DESCRIPTION OF THE PREFERRED EMBODIMENTS

Figure 1:
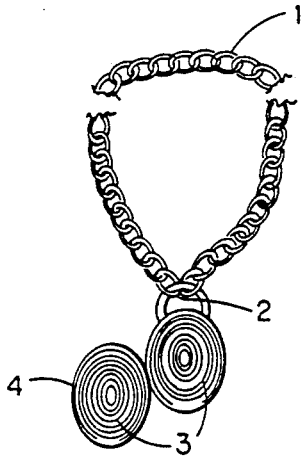
FIG. 1 is a front view of a necklace type article of fingerprint jewelry made utilizing the process.

Referring now to the drawings, FIG. 1 shows an article of jewelry consisting of a necklace, which can be made utilizing the process of this invention. As desired, a selectively sized and shaped metal jewelry piece 4 is shown containing the fingerprint of a child or other loved one, each piece being connected either to each other and/or to the necklace chain 1 by means of a loop 2, which is attached to the jewelry piece during the jewelry-making process.

Figure 2:
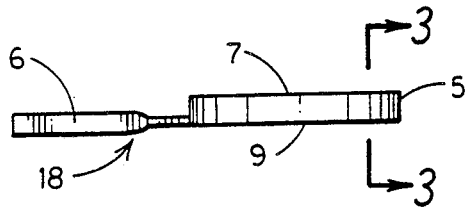
FIG. 2 is a side view of the novel sprue for obtaining the finger or digit impression and in making the jewelry.
Figure 3:
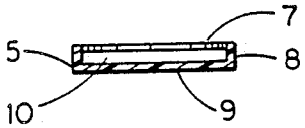
FIG. 3 is a cross section of the impression plate portion of the sprue along lines 3—3 of FIG. 2.

FIGS. 2 and 3 show the side and cross-sectional views of the sprue 18 that is used to cut the wax as well as to hold the wax during the melting and impression phases of the method. The sprue 18 comprises an impression plate 7 having a bottom surface 9 and a side wall 5 around its entire perimeter 8. Connected to this side wall 5 of the impression plate 7 is an elongated handle 6 which is utilized to hold the sprue during the jewelry making process.

The cross-sectional view in FIG. 3 shows a thin layer of wax 10 already in the impression plate said wax having been cut from a thin layer of wax in the manner set forth hereinafter. The side walls 5 on the perimeter 8 of the impression plate 7 are sufficiently rigid and narrow enough to form a cutting surface at the top similar to that of a cookie cutter when the sprue 18 is turned upside down and downward pressure is applied to the bottom surface 9 on the layer of wax. The walls 5 of the impression plate 7 are also sufficiently rigid to hold the wax 10 in place during the impression making phase of the process. The sprue would be preferably made of some type of plastic having a melting temperature higher than that of wax. The impression plate 7 may be selectively sized and shaped according to the desires of the user depending not only on the size of the digit from which the impression is to be made, but also the desired shape of the ultimate article of jewelry.

Figure 4:
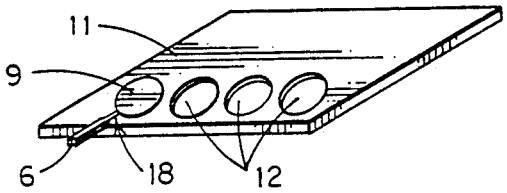
FIG. 4 is a perspective view of the sprue making cuts from a thin layer of wax.

FIG. 4 shows the wax cutting process wherein the sprue 18 is placed facing down over a thin layer of wax 11. Once in the latter position, downward pressure is inserted on the bottom surface 9 of the sprue 18 causing the walls 5 to cut through the thin layer of wax leaving the wax in the impression plate 7. Then the sprue 18 is removed by picking it up by the handle 6 for the next step in the process which is to melt the wax. A different sprue is used to cut the desired number of holes 12 in the wax 11 so that many sprues can be heated and used to make impressions almost simultaneously.

Figure 5:
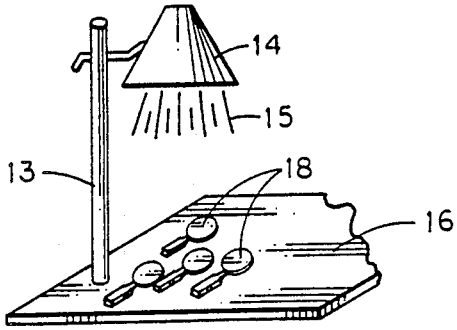
FIG. 5 is is a perspective view of a heat lamp being used to melt the surface of the wax on the impression plate.

The next step in the process is to heat the wax as shown in FIG. 5. In FIG. 5 many sprues 18 may be placed on a platform 16 beneath a heat lamp 14, or other source of heat, adjustably mounted on a pole 13. The sprues 18 are kept on the platform under the heat lamp 14 until the heat rays 15 sufficiently melt the top surface of the wax so that digit impressions may be easily and clearly made.

Figure 6:
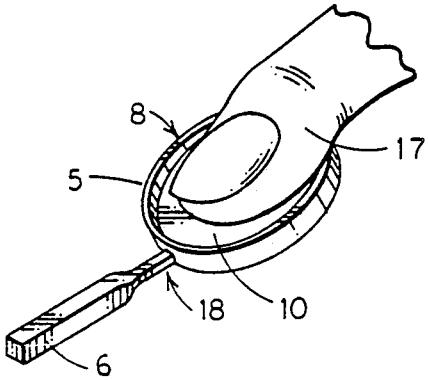
FIG. 6 is the top view of an impression being made in the wax.

As ilustrated in FIG. 6 after the wax is heated then the impression of the finger or other digit is made in the piece of wax 10 by placing the finger or other digit 17 on top of the wax 10 in the impression plate 7, applying downward pressure on the wax 10. The raised walls 5 on the perimeter 8 prevent the melted wax from spreading and becoming distorted. If it were not for the raised perimeter walls 5 on this special sprue 18 the wax 10 would merely expand into a distorted shape and not leave a proper impression.

Figure 7:
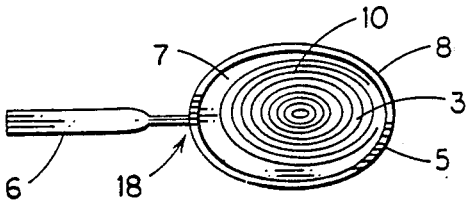
FIG. 7 is a top view of the sprue showing a fingerprint impression in the wax on the impression plate prior to casting.

In FIG. 7 the digit impression 3 is seen remaining in the piece of wax 10. This wax 10 is allowed to cool until the impression is firmly set. Once the impression is firmly set then the standard well-known jewelry making method of casting is used to obtain the impression 3 on a metal piece 4 the size of the sprue impression plate 7. Briefly, this is done by forming a cast around the sprue 18 with the sprue handle or stem 6 extending to the exterior of the cast. Then the cast is heated until the wax 10 and entire sprue 18, including impression plate 7 and handle 6, have melted leaving only an insertion cavity, where the handle 6 once existed, leaving an impression inside the cast of the print. Then molten gold or other metal is inserted through the insertion cavity into the cast so that a thin layer of metal forms over the impression, cools and hardens leaving the impression in metal contained therein. Then the cast is broken leaving only a metal piece 4 the size and shape of the impression plate 7. This piece of metal then may be mounted to a loop 2 for attachment to a necklace chain 1 or bracelet chain or to a ring loop for mounting on a finger.

In summary, as described hereinabove, this invention provides a method which effectively and efficiently obtains the impressions of fingers or other digits for making jewelry pieces containing said impressions. This invention also provides a novel sprue used in the method which enables the jewelry maker to quickly and easily cut a selectively shaped and sized piece of wax to obtain the impression thereon. The result of this method utilizing the novel sprue is a special article of jewelry which will be a memento to be worn by a mother of her children.

Although a detailed description of the preferred embodiments of the invention has been set forth herein, any variations or modifications within the scope of the claims are intended to be covered by this invention.

Having thus described my invention, I claim the following:

1. A method of obtaining a digit print impression for making jewelry to be worn as a memento and for identification purposes comprising:
   - providing a thin sheet of wax
   - cutting said selectively shaped and sized piece of wax from a thin sheet of wax;
   - enclosing said piece of wax in an impression plate
   - using a source of heat to melt the top surface of said piece of wax in said impression plate until said piece of wax becomes soft;
   - placing and pressing a digit down on said wax piece in said impression plate to form a digit imprint;
   - allowing the wax to cool until said digit imprint is firm; and
   - utilizing said digit imprinted piece of wax in said impression plate to cast a metal piece having a portion corresponding to said digit imprint.

2. The method of claim 1 wherein the cutting said selectively shaped and sized piece of wax from said thin sheet of wax is by use of a sprue containing said impression plate having rigid narrow side walls on the perimeter of said impression plate which cut through the wax when pressure is applied to a bottom surface of said impression plate.

* * * * *